US007117539B1

(12) United States Patent
Baacke

(10) Patent No.: US 7,117,539 B1
(45) Date of Patent: Oct. 10, 2006

(54) GARMENT WITH STOWABLE VEST

(75) Inventor: Dennis R. Baacke, Irma, WI (US)

(73) Assignee: JMI (USA) Ltd., Merrill, WI (US)

( * ) Notice: Subject to any disclaimer, the term of this patent is extended or adjusted under 35 U.S.C. 154(b) by 63 days.

(21) Appl. No.: 10/863,718

(22) Filed: Jun. 8, 2004

Related U.S. Application Data

(60) Provisional application No. 60/560,585, filed on Apr. 8, 2004.

(51) Int. Cl.
*A41D 1/04* (2006.01)

(52) U.S. Cl. ..... 2/102

(58) Field of Classification Search ..... 2/69, 2/102, 108, 82, 87, 84, 86, 88, 93, 94, 456, 2/69.5, 70–72, 466, 46–48, 51, 211–214
See application file for complete search history.

(56) References Cited

U.S. PATENT DOCUMENTS 2,276,775 A 3/1942 Hewton
4,689,831 A * 9/1987 Greenberger et al. ..... 2/93
4,969,214 A 11/1990 Cohen
5,077,838 A * 1/1992 Senser ..... 2/69
5,159,718 A 11/1992 Moyer
D365,194 S 12/1995 Vargo
5,588,154 A 12/1996 Blauer et al.
6,360,371 B1 * 3/2002 Davey ..... 2/86
6,421,834 B1 7/2002 Kester
6,481,017 B1 11/2002 Mullis

* cited by examiner

*Primary Examiner*—Tejash Patel
(74) *Attorney, Agent, or Firm*—Boyle Fredrickson Newholm Stein & Gratz S.C.

(57) ABSTRACT

The present invention is a stowable vest that is secured at one end within a compartment or enclosure disposed on the exterior of a garment, such as a jacket. The vest can be withdrawn from the enclosure and positioned around the garment to provide a highly visual display on the exterior of the garment. Further, the vest is easily disengagable from the exterior of the garment and reinsertable within the enclosure in order to enable the garment to function in a manner which enables an individual, such as a hunter, to selectively display the vest only when desired.

20 Claims, 3 Drawing Sheets

1/3

FIG. 6
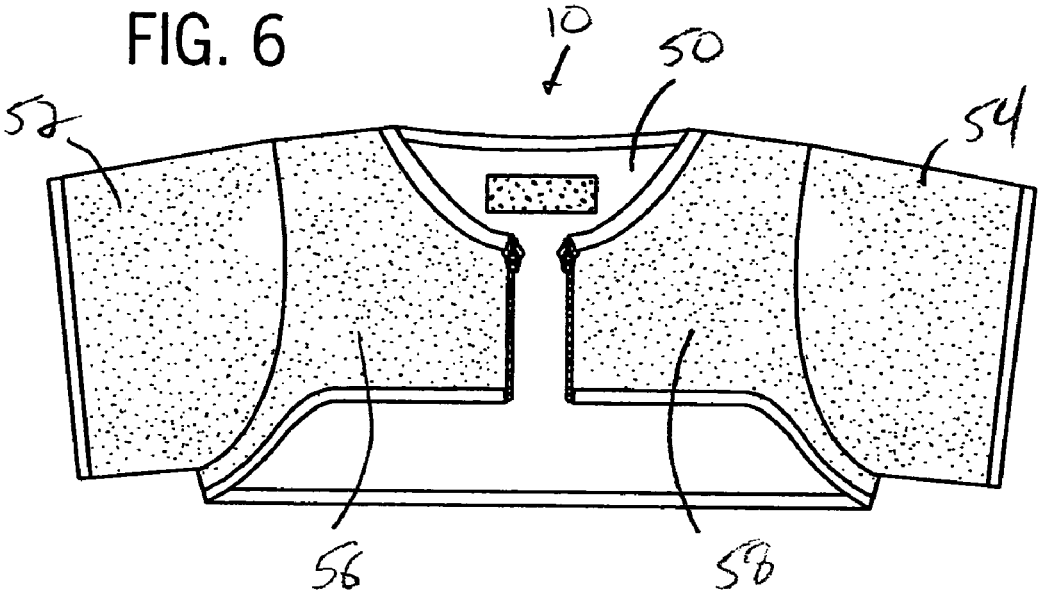
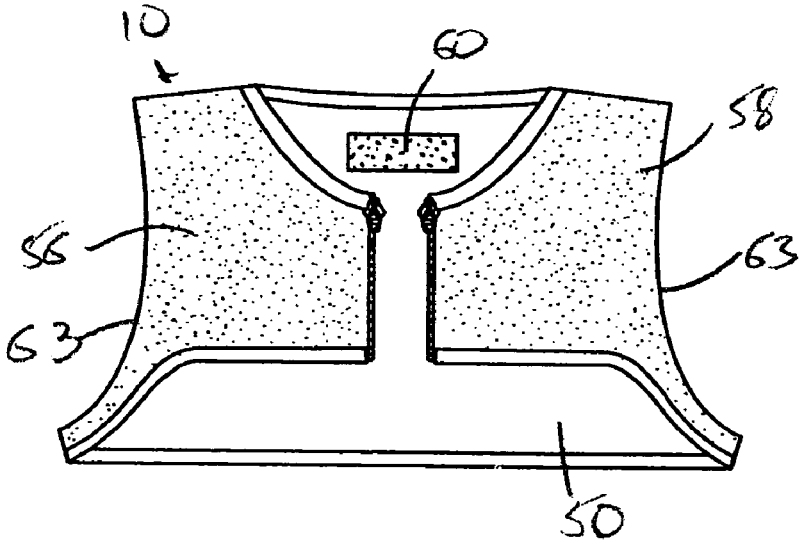
FIG. 7

GARMENT WITH STOWABLE VEST

CROSS-REFERENCE TO RELATED APPLICATIONS

This application claims priority from U.S. Provisional Patent Application Ser. No. 60/560,585, filed on Apr. 8, 2004.

FIELD OF THE INVENTION

The present invention relates to garments, and more specifically, to a garment with a vest attached thereto for selective display of the vest on the exterior of the garment.

BACKGROUND OF THE INVENTION

In certain situations such as when hunting, it is necessary for an individual to enable others to easily identify the individual as a human being and not as an animal to be hunted. To do so, a variety of garments have been designed with various attachments and other features which provide the function of identifying that of an individual wearing the garment as a human being.

Certain garments of this type are formed entirely of an easily identifiable color, i.e., blaze orange, which clearly identifies an individual as a human being when the individual is wearing the garment. However, because the color is easily identifiable and is clearly visible from a significant distance, the animals being hunted in additional to other individuals, can easily spot the garments of this color, which often times prevents an individual wearing the garment of this color from approaching the animal to be hunted undetected.

To be able to prevent detection by an animal from occurring, individuals can also wear garments formed with the easily detectable color that can be worn over an existing garment. Thus, the individual can selectively put on and take off the garment when desirous. However, because it is often necessary to quickly put on or take off the easily visible garment, with entirely separate garments of this type, it is difficult to do so. The separate garments are usually stored in a location separate from the individual, such that it requires a significant amount of time to remove the garment from this location and put it on, or to remove the garment and replace it within the storage location. Also, for those individuals choosing to wear the separate garment formed of this color over an existing, and preferably camouflaged garment, the additional garment layer can often restrict the movement of the individual making the task of hunting an animal more difficult for the individual wearing the numerous articles or layers of clothing.

In an attempt to remedy this shortcoming, certain garments have been developed which provide the ability of an individual wearing the garment to selectively display a panel or panels which have the easily-identifiable color thereon. One example of a garment of this type is disclosed in Moyer, U.S. Pat. No. 5,159,718, which illustrates a safety hunter's garment. In this garment, a number of releasable panels are secured in various points on the garment. Each of the releasable panels has a camouflage colored exterior or viewable surface and covers or obscures a safety panel having an easily identifiable colored surface that, when the releasable panel is moved from a closed position to a display position, is easily seen and identified on the exterior of the garment.

However, the releasable panels disclosed on the safety hunter's garment of the Moyer '718 patent are all located on the exterior of the garment, in locations where the panels can easily become hung up or snagged upon trees or underbrush through which the individual is walking while hunting. Furthermore, the placement and size of the safety panels on the individual are such that while the individual is walking through or sitting or standing in grass, trees and/or underbrush while hunting, the panels are small enough when they can be easily obscured by the brush, trees or grass through which the individual is walking, effectively rejecting the safety features provided by the safety panels.

As a result, it is desirable to develop a garment which is capable of being used by an individual while hunting that provides the visibility associated with a separate garment formed entirely of the easily identifiable color, but without the resulting limitations regarding the slowness in displaying and storing the garment and/or restriction of movement, while also allowing for the selective display of the garment similar to the panels disclosed in the Moyer '718 patent without the possibility of inadvertently exposing the panels on a tree or brush that the individual is moving past.

SUMMARY OF THE INVENTION

According to a primary aspect of the present invention, a stowable vest is secured within an enclosure disposed on the exterior of a garment. The vest can be quickly and easily withdrawn from within the enclosure and attached to the exterior of the garment in order to provide an easily viewable part of the garment which has a readily identifiable color. The vest is secured at one end within the enclosure in order to maintain the vest in connection with the garment. The other end of the vest is engageable with the exterior of the garment in order to position the vest over the garment in a manner which prevents the vest from obstructing the movement of the individual while the vest is displayed. When it is desired to stow the vest, the second end of the vest is disengaged from the exterior of the garment, and the vest can be quickly repositioned within the enclosure. In this configuration, no portion of the vest is displayed on the exterior of the garment, such that the individual wearing the garment can utilize a camouflage pattern on the exterior of the garment to approach an animal being hunted without being easily visually detectable.

Numerous other aspects, features and advantages of the present invention will become apparent from the following detailed description taken together with the drawing figures.

BRIEF DESCRIPTION OF THE DRAWINGS

The drawings illustrate the best mode currently contemplated of practicing the present invention.

In the drawings:

FIG. 6 is a front plan view of the vest of FIG. 1; and

FIG. 7 is a front plan view of a second embodiment of the vest of FIG. 6.

DETAILED DESCRIPTION OF THE INVENTION

Figure 1:
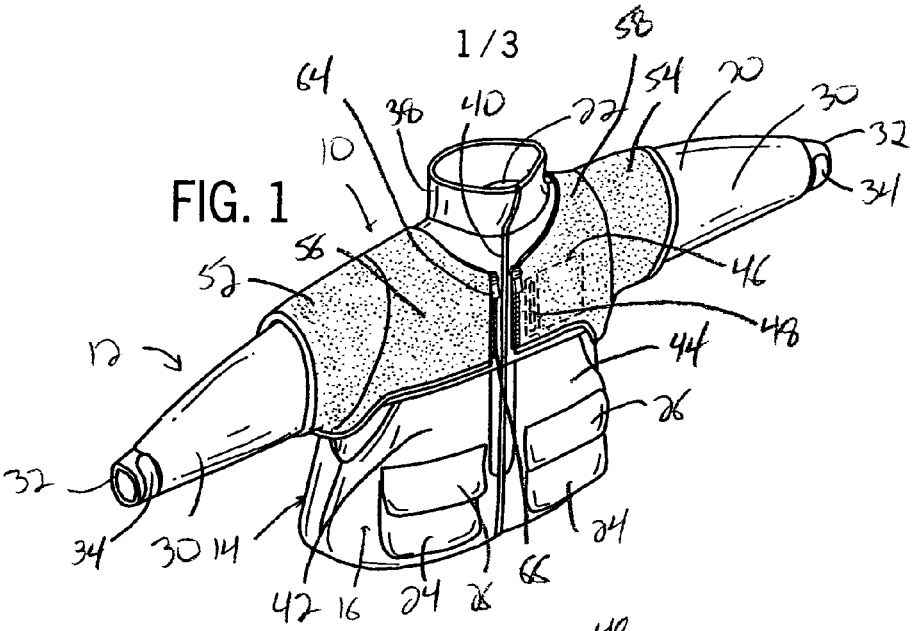
FIG. 1 is an isometric view a garment including the stowable vest of the present invention.
Figure 2:
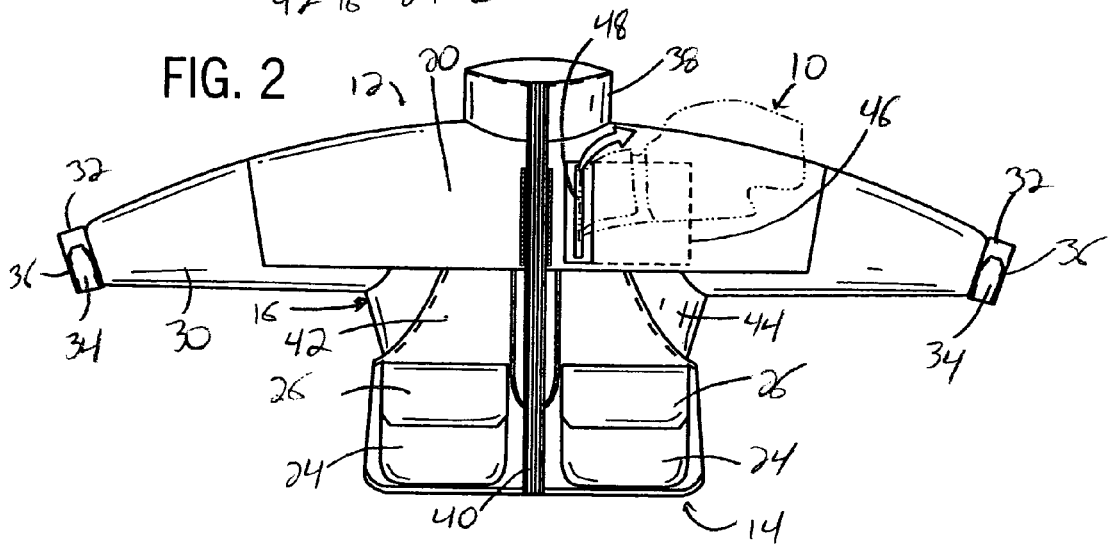
FIG. 2 is a front plan view of the garment with the vest of FIG. 1 in a stowed configuration.
Figure 3:
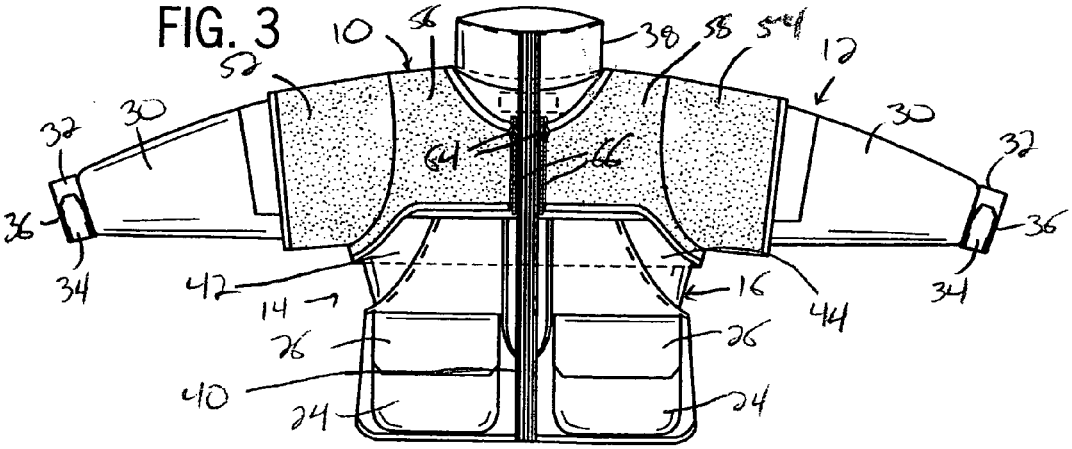
FIG. 3 is a front plan view of the garment including the vest of FIG. 2 secured to the garment in a displayed configuration.
Figure 4:
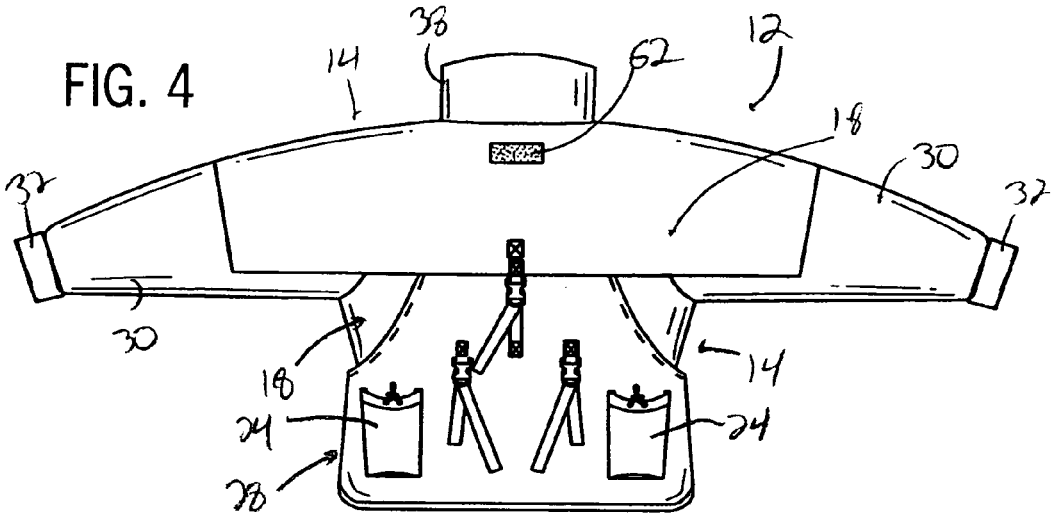
FIG. 4 is a rear plan view of the garment with the vest of FIG. 1 in a stowed configuration.
Figure 5:
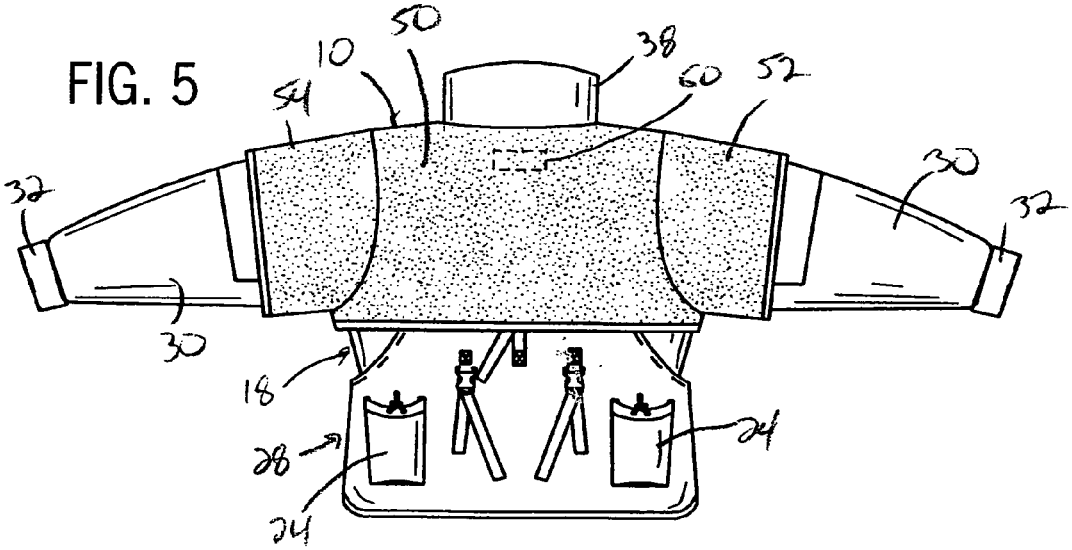
FIG. 5 is a rear plan view of a garment with the vest of FIG. 2 in the displayed configuration.

With reference now to the drawing figures in which like reference numerals designate like parts throughout the disclosure, a stowable vest constructed in accordance to the present invention is indicated generally as 10 in FIG. 1. The vest 10 is secured to a garment 12, which in a preferred embodiment is a jacket, but may also be in any other suitable type of garment capable of being worn on an individual, such as a vest, pants, poncho, jumpsuit or overalls, among others.

The garment 12 has body 14 formed of a front section 16 secured at opposite ends to a rear section 18. The front section 16 and rear section 18 define an exterior surface 20 and an interior surface 22 for the garment 12. The exterior surface 20 on the front section 16 includes a number of pockets 24 which are releasably closable by flaps 26 located adjacent and releasably engageable with the pockets 24. The flaps 26 can be engaged with the pockets 24 using any type of suitable releasable closure (not shown) such as a zipper, a snap, or a hook and loop closure, among others. Alternatively, the pockets 24 can be formed as opened ended or exposed pockets with or without a releasable closure located at the open end.

The rear section 18 may also include a number of pockets 24 or other supporting structure, but is also capable of supporting a pouch 28 thereon. The pouch 28 can be any suitable backpack-like structure, but is preferably a pouch as shown and discussed in U.S. Pat. No. 6,295,650. Alternatively, the exterior surface 20 of the rear section 18 can be devoid of any type of pocket 24 or supporting structure, if desired.

A pair of arms 30 are secured between the front section 16 and a rear section 18 on the exterior surface 12 of the body 14 and extended away from the body 14. The arms 30 include cuffs 32 located opposite the body 14. Each cuff 32 is preferably formed with an elastic material (not shown) contained within each cuff 32 to enable the cuff 32 to conform to the size of the wrist of the individual wearing the garment 12. Each cuff 32 also includes a securing strap 34 that extends outwardly from the cuff 32 and is selectively engageable with a hook and loop pad 36 disposed on the cuff 32 and spaced from the strap 34. The engagement of the strap 34 with the pad 36 enables an individual wearing the garment 12 to effectively close off the opening defined by the cuff 32 around the wrist of the individual thereby preventing a significant amount of air and/or moisture from entering the garment 12 through the cuff 32.

The body 14 also defines a neck opening (not shown) around which is disposed a collar 38. The collar 38 extends upwardly from the body 14 and serves to enclose and protect the neck of an individual wearing the garment 12.

In order to assist the individual in putting on and removing the garment 12, the front portion 16 of the body 14 also includes a zipper 40 or other suitable closure which divides the front section 16 into a pair of adjoining halves 42 and 44 that are selectively connectable by the zipper 40. The zipper 40 also extends through the collar 38 to assist in closing the color 38 around the neck of the individual.

On the exterior surface 20 of one of the halves 42 or 44 of the front section 16, the garment 12 includes an enclosure 46 having a selectively fastener closure 48. In a preferred embodiment, the enclosure 46 is disposed adjacent both the zipper 40 and the collar 38 to position the enclosure 46 at an easily reachable location for the individual wearing the garment 12, but may be located in virtually any position on the exterior surface 20 of the body 14. However, it is also contemplated that the enclosure 46 and fastener 48 can be formed separately from the garment 12, and with the enclosure 46 being secured to the exterior surface 20 of the garment 12 when desired by a suitable securing means (not shown).

Referring now to FIGS. 2–7, the stowable vest 10 includes a back portion 50, a pair of sleeves 52 and 54 connected at one side to the back portion 50, and a pair of front portion halves 56 and 58 connected to the back portion 50 and to the respective sleeves 52 and 54 opposite the back portion 50. The back portion 50 can optionally include a securing member 60 that is engageable with a complementary member 62 disposed on the exterior surface 20 of the rear section 18 of the garment 12 to hold the back portion 50 in position on the rear section 18 when the vest 10 is displayed. Further, the diameter of the sleeves 52 and 54 is greater than the diameter of the arm 30 attached to the body 14, such that the arms 30 can easily pass through the sleeves 52 and 54 when the vest 10 is being moved to the displayed position on the garment 12. However, in an alternate embodiment, the sleeves 52 and 54 are omitted, such that the back portion 50 and front halves 56 and 58 define arm openings 63 therebetween. In this embodiment, the arm openings 63 has a diameter greater than the diameter of the arms 30 to enable the arms 30 to be inserted through and move freely within the openings 63 when the vest 10 is displayed.

In order to maintain the vest 10 in engagement with the garment 12, the front portion half 56 includes a securing means 64 thereon that is located opposite the sleeve 52 and is engageable with a complementary means 66 disposed within the interior of the enclosure 46. The securing means 64 and complementary means 66 can be any suitable securing and complementary means, such as a zipper, a snap closure, a hook and loop closure, or a spring-biased clip closure, among others. The engagement between the securing means 64 and complementary means 66 ensures that the vest 10 is maintained in engagement with the garment 12, such that the vest 10 cannot be inadvertently disengaged from the garment 12, preventing the unintentional loss or misplacement of the vest 10.

Similarly, the front portion half 58 can also include a similar securing means 64 that is engageable with a complementary means 66 disposed on the exterior surface 20 of the front section half 44 in order to adequately secure the vest 10 to the exterior surface 20 of the garment 12 when displayed. However, in an alternative embodiment, due to the insertion and engagement of the arms 30 with each of the sleeves 52 and 54 of the vest 10, the engagement of the arms 30 with the sleeves 52 and 54 is also sufficient to maintain the position of the vest 10 on the garment 12, thereby making optional the presence of the second securing means and second complementary means on the front half 58. Further, the securing means 64 located on the first portion 56 can also be permanently engaged with the complementary means 66 disposed within the enclosure 46 in order to prevent any inadvertent disengagement of the respective means and removal of the vest 10 from the garment 12.

In order to move the vest 10 from a stored configuration within the enclosure 46 to a displayed configuration on the exterior of the garment 12, initially the fastener 48 on the enclosure 46 is opened to allow access to the interior of the enclosure 46. The vest 10 is then withdrawn from the enclosure and the arms 30 are inserted through the respective sleeves 52 and 54 on the vest 10. The vest 10 can then be secured to the exterior surface 20 of the garment 12 utilizing the back portion securing member 60 and the second securing means 64, if present.

When it is desired to stow the vest 10, the securing member 60 and/or securing means 64 are disengaged from the respective complementary members or means 62 and 66, and the arms 30 are withdrawn from the sleeves 52 and 54. The vest 10 can then be folded, rolled or otherwise comprised and reinserted into the enclosure. Thereafter the fastener 48 is closed, maintaining the vest 10 in the compressed configuration within the enclosure 46.

The materials utilized in forming the vest 10 are selected in order to provide a vest 10 having an easily stowable configuration and size in addition to other features desired for the vest 10. For example, the vest 10 is preferably formed of a natural or synthetic fabric material that can be easily folded or otherwise compressed to fit within the enclosure 46. The fabric material can also have other beneficial functions, such as being waterproof or reflective depending on the particular use for the vest 10. Also, while the vest 10 is disclosed as preferably being used in association with hunting garments, the stowable vest 10 is contemplated as being usable with other types of garments used for various other activities.

Various alternatives are contemplated as being within the scope of the following claims particularly pointing out and distinctly claiming the subject matter regarded as the invention.

The invention claimed is:

1. A vest adapted to be secured to a separate garment having an interior surface and an exterior surface, and movable from a stored configuration within the garment to a displayed configuration on the garment, the vest comprising:

a main body having a first end and a second end opposite the first end, the first end attachable to the garment within a first enclosure adapted to be disposed on the exterior of the garment, and a second end attachable to exterior surface of the garment, wherein the vest is adapted to be completely contained within the first enclosure.

2. The vest of claim 1 wherein the first end includes a first releasable securing means adapted to be secured within the enclosure.

3. The vest of claim 2 wherein the first releasable securing means is selected from the group consisting of: a hook and loop closure, a snap fastener, a zipper closure and a spring-biased closure.

4. The vest of claim 1 wherein the second end includes a second releasable securing means adapted to be secured to the exterior surface of the garment.

5. The vest of claim 4 wherein the second releasable securing means is selected from the group consisting of: a hook and loop closure, a snap closure, a zipper closure and a spring-biased closure.

6. A vest adapted to be secured to a separate garment having an interior surface and an exterior surface, and movable from a stored configuration within the garment to a displayed configuration on the garment, the vest comprising:

a main body having a first end and a second end opposite the first end, the first end attachable to the garment within a first enclosure adapted to be disposed on the exterior of the garment, and a second end attachable to exterior surface of the garment, wherein the vest is adapted to be completely contained within the first enclosure and further comprising a back joining the first end and the second end.

7. The vest of claim 6 wherein the back is releasably securable to the exterior of the garment.

8. The vest of claim 7 wherein the back includes a back securing means releasably securable to the exterior of the garment.

9. The vest of claim 6 further comprising a first arm opening disposed between the first end and the back, and a second arm opening disposed between the second end and back.

10. The vest of claim 9 wherein the first arm opening and second arm opening are formed as a first sleeve and a second sleeve.

11. The vest of claim 1 wherein the second end is releasably securable within a second enclosure adapted to be positioned on the exterior of the garment and spaced from the first enclosure.

12. A garment comprising:

a) a body having an exterior surface and an interior surface, the body formed from a front portion and a rear portion that are secured to one another, and an enclosure disposed on the exterior surface of the body, the enclosure including a selectively closable fastener, and b) a stowable vest having a first end, a back extending from the first end and a second end disposed opposite the first end and connected to the back, the first end including a first securing mechanism that is releasably securable within the enclosure.

13. The garment of claim 12 wherein the second end includes a second securing mechanism that is releasably securable to the exterior of the garment.

14. The garment of claim 13 wherein the first securing mechanism and the second securing mechanism are releasably securable to the exterior of the garment on opposite sides of a garment closure.

15. The garment of claim 12 wherein the garment includes a pair of arms connected to the body and engagable with the vest.

16. The garment of claim 15 wherein the vest includes a first sleeve disposed adjacent the first end and a second sleeve disposed adjacent the second end, and wherein each of the pair of arms extend through one of the first sleeve or the second sleeve.

17. A method for displaying a stowable vest attached to a garment, the method comprising the steps of:

a) providing a garment including a body having an exterior surface and an interior surface, the body formed from a front portion and rear portion secured at opposite ends to one another, and an enclosure formed on the exterior surface of the body, the enclosure including a releasable enclosure including a selectively closable fastener;

b) providing a stowable vest having a first end, a back extending from the first end, and a second end disposed opposite the first end and extending from the back, the first end including a first securing means that is securable with the enclosure;

c) removing the second end of the garment from within the enclosure; and d) securing the second end to the exterior of the garment generally opposite the enclosure.

18. The method of claim 17 wherein the step of securing the second end to the garment comprises inserting at least one arm of the garment through at least one opening formed in the vest and adjacent the second end.

19. The method of claim 17 wherein the step of securing the second end to the garment comprises engaging a second securing means located on the second end with the exterior surface of the garment.

20. The method of claim 17 further comprising the step of securing the back of the vest to the exterior of the garment after securing the second end of the garment.

* * * * *